US008951099B2

(12) United States Patent
Wu et al.

(10) Patent No.: US 8,951,099 B2
(45) Date of Patent: Feb. 10, 2015

(54) CHEMICAL MECHANICAL POLISHING CONDITIONER

(75) Inventors: Jianhui Wu, Ashland, MA (US); Richard W. J. Hall, Southborough, MA (US); Eric M. Schulz, Worcester, MA (US); Srinivasan Ramanath, Holden, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 295 days.

(21) Appl. No.: 13/393,774

(22) PCT Filed: Aug. 31, 2010

(86) PCT No.: PCT/US2010/047306

§ 371 (c)(1),
(2), (4) Date: May 15, 2012

(87) PCT Pub. No.: WO2011/028700

PCT Pub. Date: Mar. 10, 2011

(65) Prior Publication Data

US 2012/0220205 A1 Aug. 30, 2012

Related U.S. Application Data

(60) Provisional application No. 61/238,779, filed on Sep. 1, 2009.

(51) Int. Cl.
*B24B 53/00* (2006.01)
*B24B 53/007* (2006.01)

(52) U.S. Cl.
CPC ..... *B24B 53/007* (2013.01)
USPC ..... 451/443; 451/444; 451/56; 451/72; 51/307; 51/309

(58) Field of Classification Search
CPC ..... B24D 18/00; B24D 3/14; B24D 3/04; B24D 3/00; B24B 53/007
USPC ..... 451/443, 444, 56, 72; 216/11, 88; 51/307–309
See application file for complete search history.

(56) References Cited

U.S. PATENT DOCUMENTS 2,175,073 A 10/1939 Amstuz
2,194,472 A 3/1940 Jackson (Continued)

FOREIGN PATENT DOCUMENTS

DE 10109892 A1 9/2002
EP 1020303 A1 7/2000

(Continued)

OTHER PUBLICATIONS

PCT/US2010/047306 International Search Report dated Mar. 31, 2011, 14 pages.

(Continued)

*Primary Examiner* — George Nguyen
(74) *Attorney, Agent, or Firm* — Abel Law Group, LLP; Joseph P. Sullivan

(57) ABSTRACT

A chemical mechanical polishing (CMP) conditioner includes a ceramic substrate having a major surface, and an abrasive coating overlying the major surface. The major surface can include micro-protrusions arranged in a curved pattern. Alternatively, the micro-protrusions can be arranged in an irregular pattern.

15 Claims, 8 Drawing Sheets

(56) References Cited

U.S. PATENT DOCUMENTS 2,785,060 A * 3/1957 Keeleric ..... 51/309
2,820,746 A * 1/1958 Keeleric ..... 205/114
3,243,925 A 4/1966 Buzzell
3,341,984 A 9/1967 Sickel et al.
RE26,879 E 5/1970 Kelso
3,990,124 A 11/1976 MacKay, Jr. et al.
4,018,576 A * 4/1977 Lowder et al. ..... 51/309
4,222,204 A 9/1980 Benner
4,496,506 A * 1/1985 Sakato et al. ..... 264/109
4,818,515 A 4/1989 Ceresa et al.
4,925,457 A 5/1990 Dekok et al.
4,931,069 A 6/1990 Wiand
4,951,423 A 8/1990 Johnson
4,968,326 A 11/1990 Wiand
5,014,468 A 5/1991 Ravipati et al.
5,049,165 A 9/1991 Tselesin
5,152,917 A 10/1992 Pieper et al.
5,219,462 A 6/1993 Bruxvoort et al.
5,234,655 A * 8/1993 Wiech, Jr. ..... 264/227
5,304,223 A 4/1994 Pieper et al.
5,352,493 A 10/1994 Dorfman et al.
5,382,189 A 1/1995 Arendall
5,456,627 A 10/1995 Jackson et al.
5,466,431 A 11/1995 Dorfman et al.
5,472,461 A 12/1995 Li
5,492,771 A 2/1996 Lowder et al.
5,511,718 A 4/1996 Lowder et al.
5,626,509 A * 5/1997 Hayashi ..... 451/285
5,645,474 A 7/1997 Kubo et al.
5,660,881 A 8/1997 Okamura
5,667,433 A 9/1997 Mallon
5,669,943 A 9/1997 Horton et al.
5,681,362 A * 10/1997 Wiand ..... 51/298
5,683,289 A 11/1997 Hempel, Jr.
5,753,160 A * 5/1998 Takeuchi et al. ..... 264/40.1
5,791,975 A 8/1998 Cesna et al.
5,795,648 A 8/1998 Goel et al.
5,833,724 A 11/1998 Wei et al.
5,842,912 A 12/1998 Holzapfel et al.
5,851,138 A 12/1998 Hempel, Jr.
5,863,306 A 1/1999 Wei et al.
5,919,084 A 7/1999 Powell et al.
5,921,856 A 7/1999 Zimmer
5,976,204 A 11/1999 Hammarstrom et al.
5,980,678 A 11/1999 Tselesin
6,004,362 A * 12/1999 Seals et al. ..... 51/295
6,022,266 A 2/2000 Bullard et al.
6,027,659 A * 2/2000 Billett ..... 216/11
6,039,641 A 3/2000 Sung
6,059,638 A 5/2000 Crevasse et al.
6,096,107 A 8/2000 Caracostas et al.
6,099,603 A 8/2000 Johnson
6,123,612 A 9/2000 Goers
6,136,043 A 10/2000 Robinson et al.
6,136,143 A 10/2000 Winter et al.
6,159,087 A 12/2000 Birang et al.
6,200,675 B1 3/2001 Neerinck et al.
6,213,856 B1 4/2001 Cho et al.
6,234,883 B1 5/2001 Berman et al.
6,258,139 B1 7/2001 Jensen
6,261,167 B1 7/2001 Watson et al.
6,263,605 B1 7/2001 Vanell
6,286,498 B1 9/2001 Sung
6,288,648 B1 9/2001 Easter et al.
6,293,980 B2 9/2001 Wei et al.
6,309,433 B1 10/2001 Kinoshita
6,341,739 B1 * 1/2002 Hogg ..... 241/24.1
6,347,982 B1 2/2002 Holzapfel
6,358,133 B1 3/2002 Cesena et al.
6,364,742 B1 4/2002 Fukuzawa
6,368,198 B1 4/2002 Sung et al.
6,390,908 B1 5/2002 Chen et al.
6,390,909 B2 5/2002 Foster et al.
6,402,603 B1 6/2002 Watson et al.
6,416,878 B2 7/2002 An
6,419,574 B1 7/2002 Takahashi et al.
6,439,986 B1 * 8/2002 Myoung et al. ..... 451/443
6,468,642 B1 10/2002 Bray et al.
6,475,072 B1 11/2002 Canaperi et al.
6,495,464 B1 12/2002 Boyd et al.
6,508,697 B1 1/2003 Benner et al.
6,511,713 B2 1/2003 Mathisen et al.
6,537,140 B1 3/2003 Miller et al.
6,558,742 B1 * 5/2003 Tzeng ..... 427/249.8
6,572,446 B1 6/2003 Osterheld et al.
6,575,353 B2 6/2003 Palmgren
6,626,167 B2 9/2003 Kim et al.
6,626,747 B1 9/2003 Sidebottom
6,641,471 B1 11/2003 Pinheiro et al.
6,679,243 B2 1/2004 Sung
6,699,106 B2 * 3/2004 Myoung et al. ..... 451/56
6,769,975 B2 8/2004 Sagawa
6,818,029 B2 11/2004 Myoung et al.
6,821,189 B1 * 11/2004 Coad et al. ..... 451/41
6,843,952 B1 * 1/2005 Yokoyama ..... 264/496
6,887,138 B2 5/2005 Bottema et al.
6,893,336 B2 5/2005 Jin
6,945,857 B1 * 9/2005 Doan et al. ..... 451/56
7,066,795 B2 * 6/2006 Balagani et al. ..... 451/285
7,124,753 B2 10/2006 Sung
7,217,172 B2 5/2007 Benner
7,258,708 B2 8/2007 Sung
7,300,338 B2 11/2007 Wielonski et al.
7,384,436 B2 6/2008 Sung
7,467,989 B2 12/2008 Lin et al.
7,507,267 B2 3/2009 Hall et al.
7,544,114 B2 6/2009 Orlhac
7,575,503 B2 8/2009 Benner
7,641,538 B2 1/2010 Goers
7,993,419 B2 8/2011 Hall et al.
8,096,858 B2 1/2012 Sakamoto et al.
8,342,910 B2 1/2013 Dinh-Ngoc et al.
8,491,964 B1 * 7/2013 Morell et al. ..... 427/249.8
8,657,652 B2 2/2014 Hwang et al.
2002/0068518 A1 6/2002 Cesena et al.
2002/0072302 A1 6/2002 Robinson
2002/0127962 A1 * 9/2002 Cho et al. ..... 451/443
2002/0173234 A1 11/2002 Sung et al.
2002/0182401 A1 12/2002 Lawing
2002/0184829 A1 12/2002 Lemberger et al.
2002/0197947 A1 12/2002 Sagawa
2003/0036341 A1 * 2/2003 Myoung et al. ..... 451/41
2003/0114094 A1 * 6/2003 Myoung et al. ..... 451/443
2003/0175519 A1 * 9/2003 Oshima ..... 428/409
2003/0205239 A1 * 11/2003 Cho et al. ..... 134/2
2004/0009742 A1 * 1/2004 Lin et al. ..... 451/56
2004/0031438 A1 2/2004 Sung
2004/0037948 A1 2/2004 Tank et al.
2004/0072510 A1 4/2004 Kinoshita et al.
2004/0137829 A1 * 7/2004 Park et al. ..... 451/41
2004/0180617 A1 9/2004 Goers
2004/0198206 A1 10/2004 Toge et al.
2005/0025973 A1 2/2005 Slutz et al.
2005/0076577 A1 4/2005 Hall et al.
2005/0085169 A1 4/2005 Cooper et al.
2005/0097824 A1 5/2005 Braunschweig et al.
2005/0118820 A1 6/2005 Akahori et al.
2005/0153634 A1 7/2005 Prasad et al.
2005/0156362 A1 * 7/2005 Arnold et al. ..... 264/618
2005/0214201 A1 9/2005 Maruno et al.
2005/0215188 A1 9/2005 Toge et al.
2005/0260922 A1 11/2005 Gan et al.
2005/0276979 A1 * 12/2005 Slutz et al. ..... 428/408
2005/0287319 A1 * 12/2005 Miyazawa et al. ..... 428/34.1
2006/0010780 A1 1/2006 Hall et al.
2006/0073774 A1 4/2006 Sung
2006/0079162 A1 4/2006 Yamashita et al.
2006/0160477 A1 7/2006 Kinoshita et al.
2006/0213128 A1 9/2006 Sung
2006/0254154 A1 11/2006 Huang et al.
2007/0018363 A1 * 1/2007 Corrigan ..... 264/496
2007/0049185 A1 3/2007 Lin et al.
2007/0060026 A1 3/2007 Sung
2007/0066194 A1 3/2007 Wielonski et al.

(56) References Cited

U.S. PATENT DOCUMENTS

| | | | | |
|---|---|---|---|---|
| 2007/0072527 | A1 | 3/2007 | Palmgren | |
| 2007/0235801 | A1 | 10/2007 | Cheng et al. | |
| 2007/0259609 | A1 | 11/2007 | Liyoshi et al. | |
| 2008/0004743 | A1 | 1/2008 | Goers et al. | |
| 2008/0132153 | A1 | 6/2008 | Rikita et al. | |
| 2008/0153398 | A1 | 6/2008 | Sung et al. | |
| 2008/0193649 | A1 | 8/2008 | Jacquet et al. | |
| 2008/0248734 | A1 | 10/2008 | Bajaj | |
| 2008/0271384 | A1 | 11/2008 | Puthanangady et al. | |
| 2009/0053980 | A1 | 2/2009 | Hwang et al. | |
| 2009/0077900 | A1 | 3/2009 | Chuda et al. | |
| 2009/0202781 | A1 | 8/2009 | Hall et al. | |
| 2009/0206304 | A1 | 8/2009 | Dziomkina | |
| 2009/0270792 | A1* | 10/2009 | Lastovich et al. | 604/22 |
| 2009/0275274 | A1 | 11/2009 | Sakamoto et al. | |
| 2010/0022174 | A1 | 1/2010 | Chou et al. | |
| 2010/0248595 | A1* | 9/2010 | Dinh-Ngoc et al. | 451/56 |
| 2010/0330886 | A1 | 12/2010 | Wu et al. | |
| 2011/0097977 | A1 | 4/2011 | Bubnick et al. | |
| 2011/0252710 | A1 | 10/2011 | Hall et al. | |
| 2012/0060426 | A1 | 3/2012 | Puthanangady et al. | |
| 2012/0122377 | A1 | 5/2012 | Wu et al. | |
| 2012/0220205 | A1* | 8/2012 | Wu et al. | 451/443 |
| 2013/0078895 | A1 | 3/2013 | Dinh-Ngoc et al. | |
| 2013/0219801 | A1 | 8/2013 | Liebelt et al. | |
| 2013/0316630 | A1 | 11/2013 | Rothenberg et al. | |

FOREIGN PATENT DOCUMENTS

| | | | | |
|---|---|---|---|---|
| EP | 1208945 | A1 | 5/2002 | |
| EP | 1297928 | A1 | 4/2003 | |
| EP | 1346797 | A1 | 9/2003 | |
| EP | 1767312 | A1 | 3/2007 | |
| JP | 4250978 | A | 9/1992 | |
| JP | H11-77536 | A | 3/1999 | |
| JP | 2000-052254 | A | 2/2000 | |
| JP | 2000-127046 | A | 5/2000 | |
| JP | 2000190200 | A | 7/2000 | |
| JP | 2001-018172 | A | 1/2001 | |
| JP | 3261687 | B2 | 3/2002 | |
| JP | 2002-178264 | A | 6/2002 | |
| JP | 2002-200553 | A | 7/2002 | |
| JP | 2002210659 | A | 7/2002 | |
| JP | 2003-048163 | A | 2/2003 | |
| JP | 2003-053665 | A | 2/2003 | |
| JP | 2003-094332 | A | 4/2003 | |
| JP | 2003-117822 | A | 4/2003 | |
| JP | 2003-305644 | A | 10/2003 | |
| JP | 2004-025377 | A | 1/2004 | |
| JP | 2004-066409 | A | 3/2004 | |
| JP | 2004098264 | A | 4/2004 | |
| JP | 2004-202639 | A | 7/2004 | |
| JP | 2005040946 | A | 2/2005 | |
| JP | 2007-109767 | A | 4/2007 | |
| JP | 2007083389 | A | 4/2007 | |
| JP | 4084944 | B2 | 4/2008 | |
| JP | 2008-114334 | A | 5/2008 | |
| JP | 2008-186998 | A | 8/2008 | |
| JP | 2008-229775 | A | 10/2008 | |
| KR | 10-2001-0032812 | A | 4/2001 | |
| KR | 2002-0036138 | A | 5/2002 | |
| KR | 20-0298920 | Y1 | 1/2003 | |
| KR | 10-2009-0013366 | A | 2/2009 | |
| KR | 20090013366 | A | 2/2009 | |
| KR | 20090082360 | A | 7/2009 | |
| WO | 98/45092 | A1 | 10/1998 | |
| WO | WO 9943491 | A1 * | 9/1999 | B32B 3/00 |
| WO | 2005/039828 | A1 | 5/2005 | |
| WO | 2005039828 | A1 | 5/2005 | |
| WO | 2007/149683 | A2 | 12/2007 | |
| WO | 2008/002735 | A2 | 1/2008 | |
| WO | 2008/036892 | A1 | 3/2008 | |
| WO | 2009/026419 | A1 | 2/2009 | |
| WO | 2012/004376 | A1 | 1/2010 | |
| WO | 2010/110834 | A1 | 9/2010 | |
| WO | 2010/141464 | A2 | 12/2010 | |
| WO | 2013/166375 | A1 | 11/2013 | |

OTHER PUBLICATIONS

"Electrical Discharge Machining", Wikipedia, 6 pages.

De Pellegrin, D.V., t al., "The Measurement and Description of Diamond Shape in Abrasion," Department of Mechanical and Manufacturing Engineering, Univeristy of Dublin, Ireland, 16 pgs.

Elmufdi, Carolina, L., et al., "The Impact of Pad Microtexture and Materials Properties on Surface Contact and Defectivity in CMP,"Pad Engineering Research Group, 11th International CMP Symposium, Lake Placid, NY, Aug. 15, 2006, 18 pgs.

Hwang, Taewook et al., "Advanced Pad Conditioner Design for Oxide/Metal CMP," Saint-Gobain High Performance Materials, Transactions on Electrical and Electronic Materials, vol. 7, No. 2, Apr. 2006, pp. 62-66.

Hwang, Taewook et al., "Optimized and Customized CMP Conditioner Design for Next Generation Oxide/Metal CMP," Saint-Gobain High Performance Materials, 6 pgs.

Lawing, A. Scott, "Pad Conditioning and Textural Effects in Chemical Mechanical Polishing," Rohm and Haas Electronic Materials CMP Technologies, CMP-MIC Conference, Feb. 23-25, 2005, pp. 33-42.

Popp, U., et al "Properties of Nanocrystalline Ceramic Powders Prepared by Laser Evaporation and Recondensation", Journal of the European Ceramic Society 18 (1998) 1153-1160, Copyright 1998 Elsevier Science Limited, 8 pages.

Li, et al, "The effect of the polishing pad treatments on the chemical-mechanical polishing of SiO2 films", Thin Solid Films 270 (1995) pp. 601-606.

Stavreva, et al, "Characteristics in Chemical-Mechanical Polishing of Copper: Comparison of Polishing Pads", Applied Surface Science 108 (1997) pp. 39-44.

Chan, et al, "A preliminary study of gentle CVDD pad dressers potential for fixed abrasives conditioning", Nov. 19-20, 2002 VMIC Conference, 2002 IMIC-400/00/0395; pp. 395-398.

Sung, "CMP Pad Dresser: A Diamond Grid Solution," DiaGrid(r) CMP conditioner, Kinik Company, Taiwan, 41 pages.

Koshy, P., et al, "Surface Generation with Engineered Diamond Grinding Wheels: Insights from Simulation," McMaster Manufacturing Research Institute; McMaster University, Hamilton, Canada; 5 pages.

East Diamond Industrial Co.,Ltd. and Hunan Real Tech Superabrasive & Tool Co.,Ltd. "Diamond Grain Mesh Size/Grit Size Comparison Chart", 1 page <http://www.china-superabrasives.com/diamond_mesh_size.htm>.

"Abrasive and Compounds," http://www.newportglass.com/grit.htm.

International Search Report for PCT/US2010/036895 mailed Mar. 14, 2011, 1 page.

International Search Report for PCT/US2009/069961 mailed Aug. 13, 2010, 1 page.

International Search Report for PCT/US2004/28881 mailed Dec. 23, 2004, 1 page.

International Search Report for PCT/US2008/073823 mailed Nov. 26, 2008, 1 page.

International Search Report for PCT/US2007/079154 mailed Jan. 18, 2008, 1 page.

International Search Report for PCT/US2013/039447 mailed Sep. 17, 2013, 1 page.

* cited by examiner

CHEMICAL MECHANICAL POLISHING CONDITIONER

CROSS-REFERENCE TO RELATED APPLICATION

The present application claims priority from PCT Application No. PCT/US10/047,306, filed Aug. 31, 2010, entitled "CHEMICAL MECHANICAL POLISHING CONDITIONER" naming inventors Jianhui W U, Richard W. J. HALL, Eric M. SCHULZ and Srinivasan RAMANATH which in turn claims priority to U.S. Provisional Patent Application Ser. No. 61/238,779 filed on Sep. 1, 2009, entitled "CHEMICAL MECHANICAL POLISHING CONDITIONER" naming inventors Jianhui W U, Richard W. J. HALL, Eric M. SCHULZ and Srinivasan RAMANATH, which are all incorporated by reference herein in their entirety.

FIELD OF THE DISCLOSURE

The present disclosure generally relates to chemical mechanical polishing (CMP) conditioners, and more particularly relates to a ceramic substrate based CMP conditioner.

BACKGROUND

Chemical mechanical polishing is widely used in the manufacturing of semiconductor devices to obtain a smooth and even surface of the wafers. Typically, the wafer to be polished is held by a carrier positioned on a polishing pad attached above a rotating platen. By applying slurry to the pad and pressure to the carrier, the wafer is polished by relative movements of the platen and the carrier. A conventional polishing pad used in the chemical mechanical polishing process generally comprises a multitude of fine holes having a diameter of not greater than 200 microns. The holes can exhibit a pumping effect when pressure is applied to the polishing pad to achieve a high removal rate. However, after prolonged use, the holes can wear out or become blocked with polishing residues, causing an uneven surface of the polishing pad. As a result, the ability to polish wafers decreases over time and the effectiveness of CMP process for achieving a uniformly smooth wafer surface can be diminished.

To recover the polishing performance and to compensate for the uneven surface of the polishing pads, a conditioning process utilizing a conditioner for removing the uneven surface of the polishing pads is commonly used along with CMP processing.

SUMMARY

In a first aspect, a chemical mechanical polishing (CMP) conditioner can include a ceramic substrate having a major surface and an abrasive coating overlying the major surface. The major surface can include micro-protrusions arranged in a curved pattern or in an irregular pattern.

In another aspect, a method of forming chemical mechanical polishing (CMP) conditioner includes forming a green body having a major surface, sintering the green body to form a ceramic substrate, and depositing an abrasive coating overlying the ceramic substrate. The major surface including plurality of micro-protrusions;

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items.

DETAILED DESCRIPTION

In an embodiment, a chemical mechanical polishing (CMP) conditioner can include a substrate. The substrate can include a metal and metal alloys including tungsten, molybdenum, zirconium, copper, nickel, stainless steel, or the like. Alternatively, the substrate can include a ceramic, such as oxides, carbides, nitrides, oxynitrides, silicides, borides, or any combination thereof. Examples include Al2O3, SiC, WC, Si3N4, ZrO2, Cr2N3, and the like. Preferably, the substrate is chosen to be resistant to corrosion from the CMP environment. The substrate can have a thickness of between about 2 mm and about 15 mm.

Figure 1:
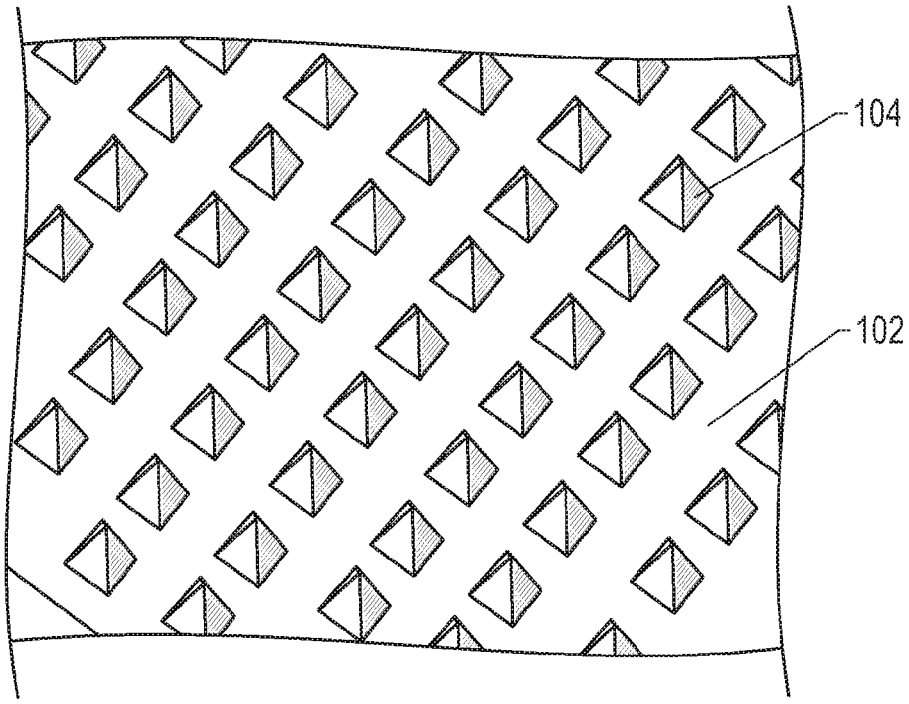
FIG. 1 is illustration an embodiment of a surface of a substrate including a plurality of micro-protrusions.

A surface of the substrate can include a plurality of micro-protrusions. FIG. 1 shows an example of a surface 102 with a plurality of micro-protrusions 104. The micro-protrusions can be formed from the same material as the substrate. Additionally, the micro-protrusions can be continuous with the substrate and free of a boundary between the micro-protrusions and the substrate. Specifically, the substrate and the micro-protrusions are co-formed as a monolithic structure, rather than the micro-protrusions being formed separately from the substrate and applied to the substrate using an adhesion layer or other bonding technique.

In an embodiment, the micro-protrusions can have a size between about 1 micron and about 2000 microns, such as between about 5 microns and about 500 microns, even between about 10 microns and about 250 microns. In an embodiment, the plurality of micro-protrusions can have substantially the same size. Alternatively, a first set of the micro-protrusions can be smaller than a second set of the micro-protrusions. For example, the first set of the micro-protrusions may have a smaller height and/or a smaller width or diameter.

In an alternate embodiment, the micro-protrusions may have an extended length, such as greater than about 2000 microns. However, height of the extended micro-protrusions can be between about 1 micron and about 2000 microns, such as between about 5 microns and about 500 microns, even between about 10 microns and about 250 microns. Similarly, the width of the extended micro-protrusions can be between about 1 micron and about 2000 microns, such as between about 5 microns and about 500 microns, even between about 10 microns and about 250 microns.

In an embodiment, the micro-protrusions can be used as cutting elements of the conditioning pad. Alternatively, the micro-protrusions can be coated in an abrasive coating, such as a diamond film, a diamond-like film, a cubic boron nitride film, or the like. The abrasive coating can have an average thickness of at least about 0.5 microns, such as at least about 1.0 microns, even at least about 2.0 microns. Additionally, the abrasive coating can have an average thickness of not greater than about 15 microns, such as not greater than about 10 microns. Further, the thickness of the abrasive coating can have a variation of not greater than about 15%. The abrasive coating can provide further protection from corrosion and increase the cutting performance of the conditioning pad. The abrasive coating can be deposited using chemical vapor deposition (CVD), physical vapor deposition (PVD), or other known techniques for depositing films. In particular, a diamond film can be deposited using hot filament deposition or microwave deposition. The diamond film can include nanocrystalline diamond, microcrystalline diamond, or any combination thereof. Typically, nanocrystalline diamond can have a grain size of less than about 10 microns and can have a grain size of greater than about 1 micron. Microcrystalline diamond can have a grain size of greater than 10 microns, generally less than about 100 microns.

Figure 10:
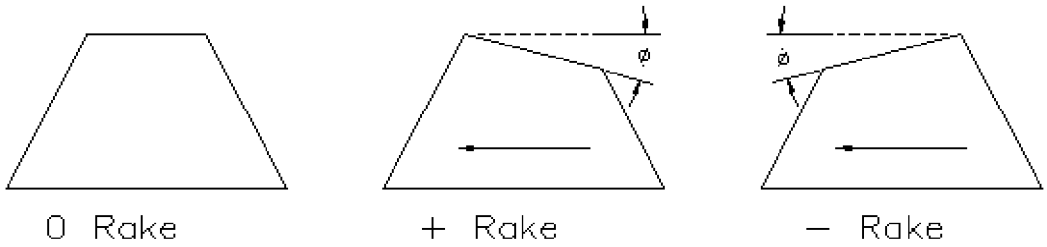
FIG. 10 is a diagram illustrating micro-protrusions having zero, positive, and negative rake angles.

In an embodiment, the micro-protrusions can have substantially the same shape. Alternatively, a first portion of the micro-protrusions can have a first shape, and a second portion of the micro-protrusions can have a second shape. The micro-protrusions can be formed in a variety of shapes. For example, the micro-protrusions can be polygons or modified polygons. Examples of polygons include pyramids, such as triangular pyramids and square or rectangular pyramids, and parallelepipeds, such as cubes and rectangular prisms. Generally, polygons have sharp edges and vertices. Modified polygons can be polygons having rounded edges or vertices. Additionally, modified polygons can have convex or concave curved surfaces that meet at an edge. Further, the micro-protrusions may have a rake angle of zero, a positive rake angle, or a negative rake angle, as shown in FIG. 10. The rake angle is the angle of the top surface of the micro-protrusion relative to the horizontal taken from the leading edge to the trailing edge of the micro-protrusion. For a zero rake angle, the height of the leading edge can be the same as the height of the trailing edge of the micro-protrusion. A micro-protrusion having a positive rake angle can have a leading edge that is higher than the trailing edge, whereas a micro-protrusion having a negative rake angle can have a leading edge that is lower than the trailing edge.

In an embodiment, the micro-protrusions can be oriented in the same direction. That is the corresponding vertices of each micro-protrusion can be aligned in substantially the same direction. Alternatively, a first set of micro-protrusions can be orientated in a first direction and a second set of micro-protrusions can be oriented in a second direction. In yet another embodiment, the orientation of the micro-protrusions can be substantially random.

Figure 2:
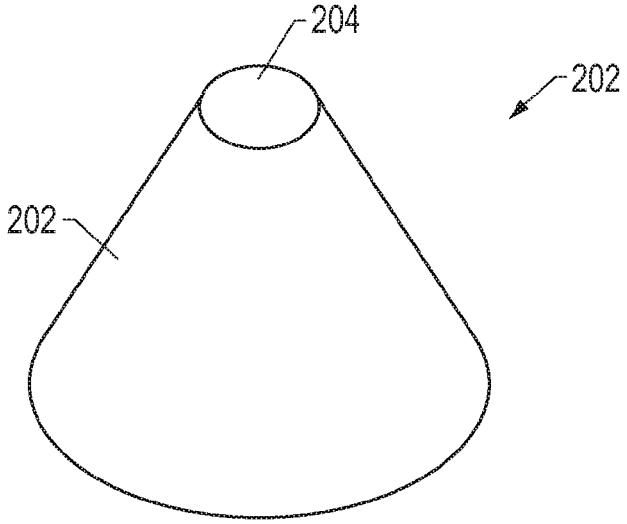
FIG. 2 is a diagram illustrating an exemplary curved conical shape.

Alternatively, the micro-protrusions can be non-polygonal micro-protrusions. Examples of non-polygonal micro-protrusions include cones and rounded cones, and hemispheres and partial spheres. Generally, non-polygonal micro-protrusions do not have edges. FIG. 2 illustrates an example of a non-polygonal shape 200. Specifically, a cone 202 has a rounded vertex 204. The non-polygonal shape 200 can improve the uniformity of the CMP conditioning process, since the profile of the non-polygonal shape does not change as the conditioner is rotated.

Figure 3:
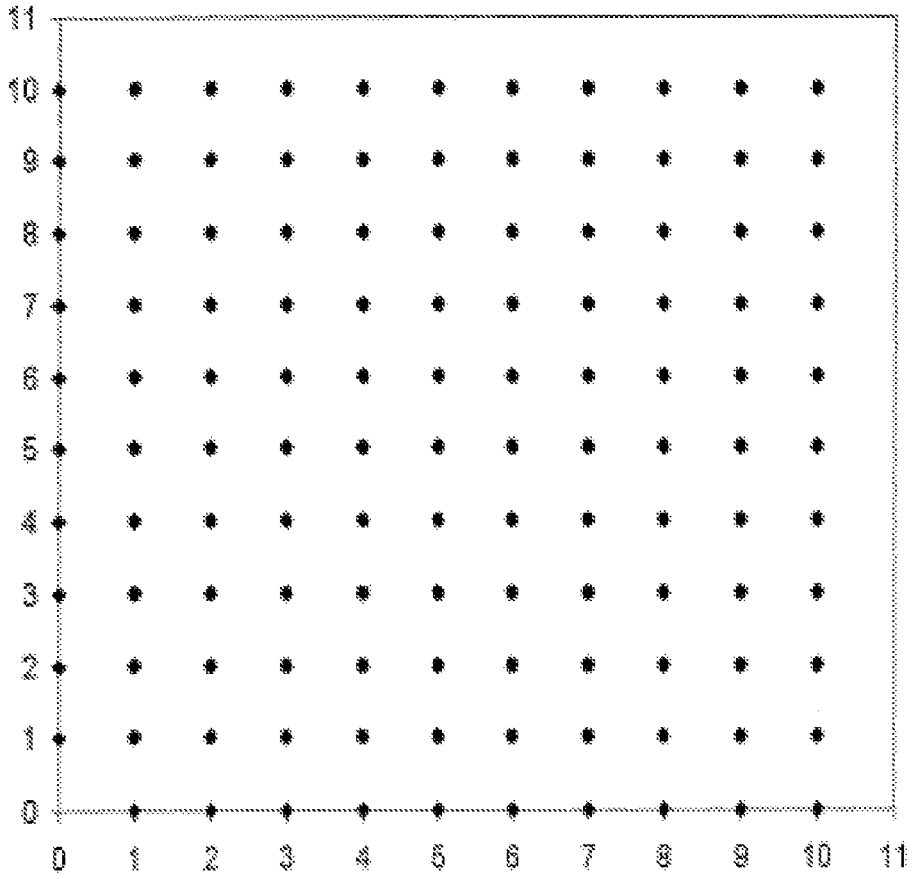
FIG. 3 is a diagram illustrating an exemplary regular pattern.

In an embodiment, the micro-protrusions can be arranged in a pattern. The pattern can be a regular pattern, such as rectangular array where adjacent micro-protrusions are spaced apart by a substantially constant distance. FIG. 3 is an illustration of a graph of micro-protrusion distribution corresponding to a uniform grid of x, y coordinate values and showing regular gaps between consecutive coordinate values along the x and y axes.

Figure 4:
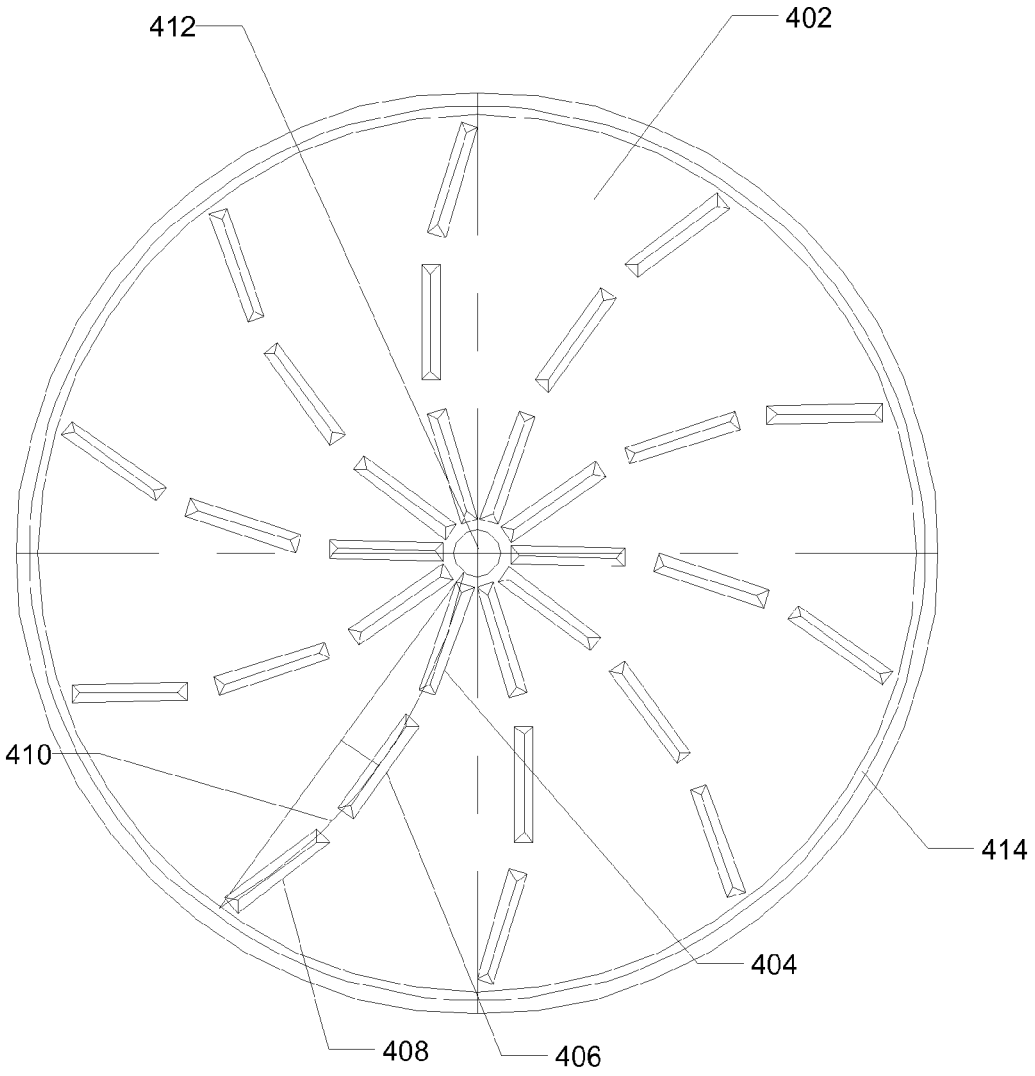
FIG. 4 is an illustration of an embodiment including a plurality of micro-protrusions in a curved pattern.

Alternatively, the regular pattern can be a curved pattern, such as a swirl pattern or a spiral pattern. Generally, in a curved pattern, adjacent micro-protrusions can be arranged to follow an arc having a radius of curvature. The radius of curvature may be constant along the length of the arc, or may vary, being larger in one region of the arc and smaller in another region of the arc. FIG. 4 shows an exemplary embodiment of a substrate 402 having micro-protrusions 404, 406, and 408 arranged in a curved pattern. Micro-protrusions 404 through 408 can be arranged along arc 410 extending from the center 412 to the edge 414 of the substrate.

In an alternate embodiment, the micro-protrusions can be arranged in an irregular pattern. Generally, in an irregular pattern, the spacing between adjacent pairs of micro-protrusions can be randomly distributed. While some irregular patterns may define a minimum distance and/or a maximum distance between adjacent pairs, the spacing between adjacent pairs can be substantially randomly distributed within the allowable range. Additionally, an irregular pattern may have a defined density, such that there is substantially the same number of micro-protrusions per cm2 at various places across the surface of the conditioner.

Figure 5:
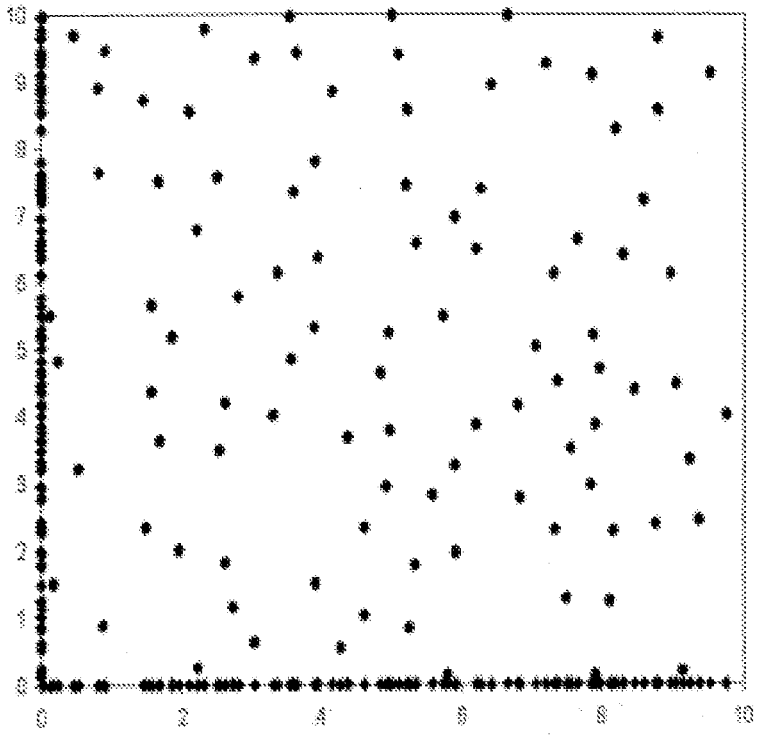
FIGS. 5 and 6 are diagrams illustrating exemplary irregular patterns.

FIG. 5 is an illustration of a graph of a micro-protrusion array of the invention, showing a random array of x, y coordinate values which have been restricted such that each pair of randomly generated coordinate values differs from the nearest coordinate value pair by a defined minimum amount (k) to create an exclusionary zone around each point on the graph.

Figure 6:
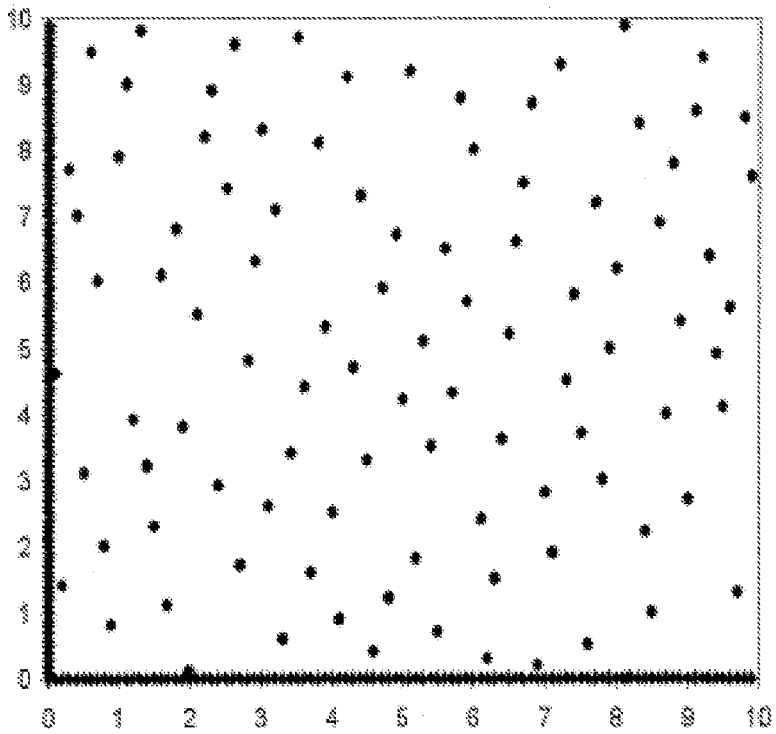

FIG. 6 is an illustration of a graph of an abrasive grain array of the invention, showing an array that has been restricted along the x and y axes to numerical sequences wherein each coordinate value on an axis differs from the next coordinate value by a constant amount. The array has been restricted further by decoupling coordinate value pairs, and randomly reassembling the pairs such that each randomly reassembled pair of coordinate values is separated from the nearest pair of coordinate values by a defined minimum amount.

Figure 7:
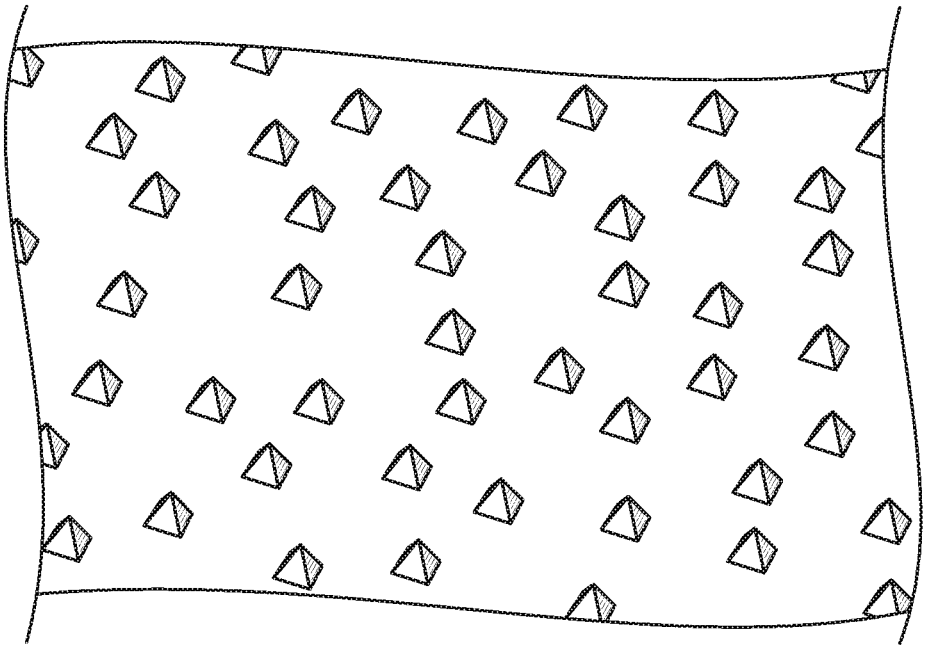
FIG. 7 is an illustration of a plurality of micro-protrusions in an irregular pattern.

In yet another embodiment, a first portion of the micro-protrusions can be arranged in a regular pattern and a second portion of the micro-protrusions can be arranged in an irregular pattern. For example, micro-protrusions in an irregular patterned as shown in FIG. 7 can be interspersed between the arcs of the curved pattern shown in FIG. 4.

Figure 8:
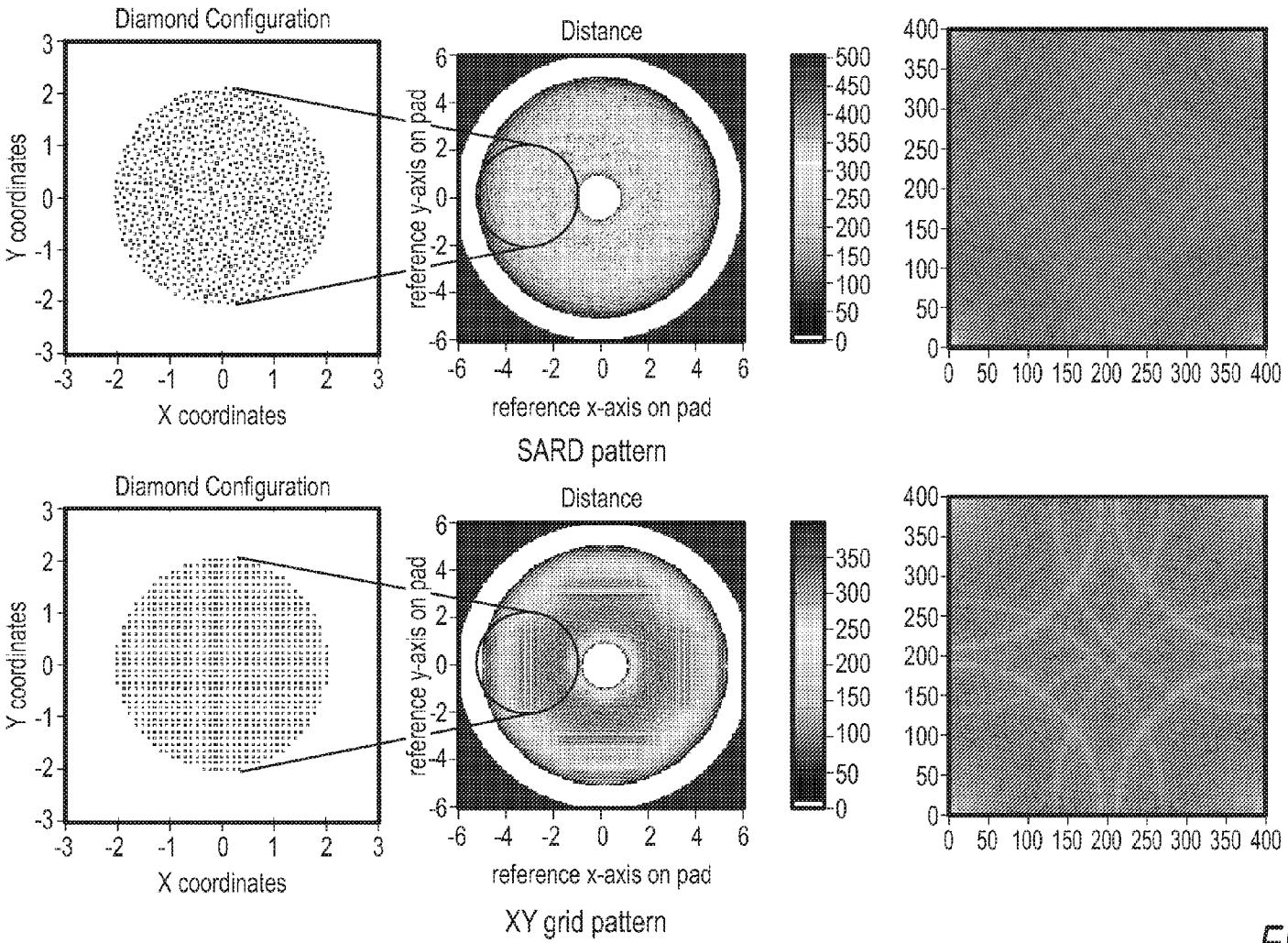
FIG. 8 is an image showing wear patterns of a CMP conditioner with an irregular pattern and a CMP conditioner with a regular pattern.

A CMP conditioner having at least a portion of the micro-protrusions arranged in an irregular pattern can have particular benefits over CMP conditioners having micro-protrusions arranged in a regular pattern, such as a rectangular array. As seen in FIG. 8, a CMP conditioner having a rectangular array of micro-protrusions can leave distinct wear patterns in the surface of the CMP pad, whereas a CMP conditioner having an irregular pattern of micro-protrusions can be less likely to leave wear patterns in the surface of the CMP pad. The wear patterns can result in a non-uniform surface of the polishing pad which can negatively effect the ability to achieve a smooth and even surface on the wafer being polished.

Figure 9:
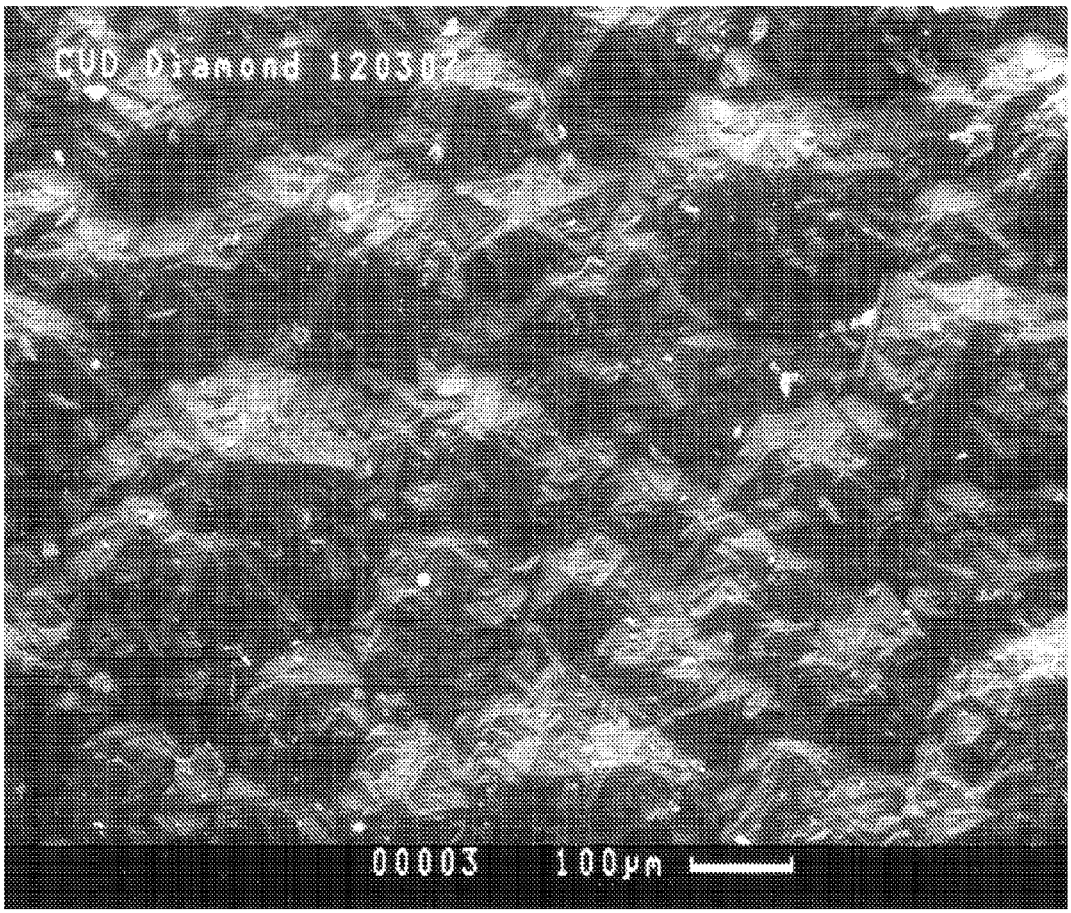
FIG. 9 is an electron micrograph showing a chemical vapor deposition (CVD) diamond layer deposited on the substrate.

In an embodiment, an abrasive coating may be deposited overlying the major surface such as by using chemical vapor deposition, physical vapor deposition, or other known deposition techniques. The abrasive coating can be deposited to an average thickness of at last about 1.0 microns, such as at least about 2.0 microns. Further, the abrasive coating can have an average thickness of not greater than about 15 microns, such as not greater than about 10 microns. The abrasive coating can include a diamond coating, a diamond-like coating, a cubic boron nitride coating, or any combination thereof. In a particular embodiment, the abrasive coating may be a diamond coating deposited using hot filament deposition or microwave deposition. Additionally, the diamond coating can be polycrystalline, including nanocrystalline diamond, microcrystalline diamond, or the like. FIG. 9 is an electron micrograph showing a CVD diamond layer deposited on the surface of an exemplary CMP conditioner.

Turning to the process for making the CMP conditioner, in an embodiment, a green body having a plurality of micro-protrusions can be formed by pressing a ceramic material into a mold. Forming the substrate and the micro-protrusions as a single component reduces the likelihood that the micro-protrusions will separate from the body of the substrate during use. Heat may be supplied to the ceramic material during pressing. Further, a release agent may be applied to the mold before addition of the ceramic material. The ceramic material can include Al2O3, SiC, WC, Si3N4, ZrO2, Cr2N3, or the like. The ceramic material can be a ceramic powder, a sol gel, or other form adaptable for filling the mold.

The green body can be sintered to form a ceramic substrate having a plurality of micro-protrusions. In an embodiment, the green body can be machined prior to sintering to add additional surface features. For example, molding the micro-protrusions onto the surface and then machining the surface to create the islands can form large islands having micro-protrusions. In an alternate embodiment, the ceramic substrate can be formed by heating the ceramic material to a sintering temperature during pressing, eliminating the need for sintering in a subsequent step.

In an embodiment, an abrasive coating can be applied to the surface of the ceramic substrate. For example, chemical vapor deposition can be used to apply a polycrystalline diamond coating to the surface of the ceramic substrate. In an embodiment, the diamond coating can be applied directly overtop the ceramic substrate, such that the conditioner is free of any intermediate layers, such as adhesion or bonding layers, between the ceramic substrate and the abrasive layer. The diamond coating can improve the corrosion resistance of the CMP conditioner as well as providing additional abrasive properties.

The mold can be formed to create a pattern of recesses within the mold corresponding to the pattern of micro-protrusions on the desired CMP conditioner. For example, the mold can be patterned, such as by electrical discharge machining (EDM) such as micro-EDM, electrochemical machining (ECM), lithography and chemical etching, water jet cutting, laser cutting, or other known techniques.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

As used herein, the terms "comprises," "comprising," "includes," "including," "has," "having" or any other variation thereof, are intended to cover a non-exclusive inclusion. For example, a process, method, article, or apparatus that comprises a list of features is not necessarily limited only to those features but may include other features not expressly listed or inherent to such process, method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A chemical mechanical polishing (CMP) conditioner comprising:

a ceramic substrate having a major surface, the major surface including micro-protrusions, at least a portion of the micro-protrusions being arranged in an irregular pattern, wherein the irregular pattern has a minimum spacing between adjacent micro-protrusions, wherein the distance between each adjacent pair of micro-protrusions is substantially randomly distributed within the minimum spacing; and an abrasive coating overlying the major surface.

2. The CMP conditioner as recited in claim 1, wherein an additional portion of the micro-protrusions are arranged in a regular pattern.

3. The CMP conditioner as recited in claim 1, wherein the micro-protrusions are non-polygonal.

4. The CMP conditioner as recited in claim 1, wherein a number of micro-protrusions per $cm^2$ on the major surface is substantially uniform.

5. A chemical mechanical polishing (CMP) conditioner comprising:

a ceramic substrate having a major surface, the major surface including micro-protrusions arranged in a pattern, wherein at least a portion of the micro-protrusions have a height of a trailing edge that is different from a height of a leading edge, the trailing edge and the leading edge at least partly defining a top surface of each respective micro-protrusion of the portion of micro-protrusions; and an abrasive coating overlying the major surface.

6. The CMP conditioner as recited in claim 5, wherein the height of the leading edge is greater than the height of the trailing edge.

7. The CMP conditioner as recited in claim 5, wherein the height of the leading edge is less than the height of the trailing edge.

8. The CMP conditioner as recited in claim 5, wherein the ceramic substrate includes $Al_2O_3$, SiC, WC, $Si_3N_4$, $ZrO_2$, $Cr_2N_3$, or any combination thereof.

9. The CMP conditioner as recited in claim 5, wherein the abrasive coating has an average thickness of at least about 0.5 microns and no greater than about 15 microns.

10. The CMP conditioner as recited in claim 5, wherein the thickness of the abrasive coating has a variation of no greater than about 15%.

11. The CMP conditioner as recited in claim 5, wherein the CMP conditioner is free of an intermediate layer between the ceramic substrate and the abrasive coating.

12. A chemical mechanical polishing (CMP) conditioner comprising:

a substrate having a major surface, the major surface including micro-protrusions arranged in a pattern, wherein a first portion of the micro-protrusions have a first shape and a second portion of the micro-protrusions have a second shape that is different from the first shape; and an abrasive coating overlying the major surface.

13. The CMP conditioner as recited in claim 12, wherein the substrate includes one or more materials selected from the following group: W, Mb, Zr, Cu, Ni, stainless steel.

14. The CMP conditioner as recited in claim 12, wherein the micro-protrusions have a height between about 1 micron to about 2000 microns.

15. The CMP conditioner as recited in clam 12, wherein the micro-protrusions have a width between about 1 micron to about 2000 microns.

* * * * *